US011542684B2

(12) United States Patent
Ahn et al.

(10) Patent No.: US 11,542,684 B2
(45) Date of Patent: Jan. 3, 2023

(54) HYDRAULIC MACHINE

(71) Applicant: VOLVO CONSTRUCTION EQUIPMENT AB, Eskilstuna (SE)

(72) Inventors: Hoenghwan Ahn, Gimhae-si (KR); Taerang Jung, Yangsan-si (KR); Sangkyu Joo, Changwon-si (KR); Seonggeun Yun, Changwon-si (KR); Seunghyun Lee, Changwon-si (KR); Byoungho Lee, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 17/740,908

(22) Filed: May 10, 2022

(65) Prior Publication Data

US 2022/0364327 A1 Nov. 17, 2022

(30) Foreign Application Priority Data

May 13, 2021 (KR) ..... 10-2021-0062103

(51) Int. Cl.

| | |
|---|---|
| ***E02F 9/22*** | (2006.01) |
| ***F15B 21/14*** | (2006.01) |
| ***F15B 1/02*** | (2006.01) |
| ***F15B 11/024*** | (2006.01) |

(52) U.S. Cl.

CPC ..... *E02F 9/2217* (2013.01); *E02F 9/2296* (2013.01); *F15B 1/024* (2013.01); *F15B 11/024* (2013.01); *F15B 21/14* (2013.01); *F15B 2211/88* (2013.01)

(58) Field of Classification Search

CPC ..... F15B 1/024; F15B 11/024; F15B 2011/0243; F15B 2011/0246; F15B 21/14; E02F 9/2217

See application file for complete search history.

(56) References Cited

U.S. PATENT DOCUMENTS

| | | | | |
|---|---|---|---|---|
| 7,562,615 | B2 * | 7/2009 | Abe | E02F 9/2296 91/445 |
| 9,790,966 | B2 * | 10/2017 | Akiyama | E02F 9/2242 |
| 9,890,518 | B2 * | 2/2018 | Sato | E02F 9/2221 |
| 10,669,695 | B2 * | 6/2020 | Ito | F15B 11/05 |
| 2017/0276151 | A1 * | 9/2017 | Joung | E02F 9/2267 |

FOREIGN PATENT DOCUMENTS

| | | | | |
|---|---|---|---|---|
| WO | WO-2016169939 | A1 * | 10/2016 | E02F 9/2217 |

* cited by examiner

*Primary Examiner* — Michael Leslie

(74) *Attorney, Agent, or Firm* — Sage Patent Group

(57) ABSTRACT

A hydraulic machine is provided. A boom actuator includes a large chamber and a small chamber. A recovery unit receives fluid discharged from the large chamber and then recovers energy. A recovery line connects the large chamber and the recovery unit. An accumulator is connected to the recovery line. A jack-up assist line connects the accumulator and the small chamber. A jack-up assist valve is disposed on the jack-up assist line to block flow of fluid from the accumulator to the small chamber in a first position and allow the flow of fluid from the accumulator to the small chamber in a second position. A controller controls movement of the jack-up assist valve. The controller may determine whether or not the hydraulic machine is in a jack-up condition, and when the hydraulic machine is determined to be in the jack-up condition, moves the jack-up assist valve to the second position.

6 Claims, 4 Drawing Sheets

HYDRAULIC MACHINE

CROSS REFERENCE TO RELATED APPLICATIONS

This application claims foreign priority to Korean Application No. 10-2021-0062103, filed on May 13, 2021, the disclosure and content of which is incorporated by reference herein in its entirety.

Technical Field

The present disclosure relates generally to a hydraulic machine and, more particularly, to a hybrid hydraulic machine configured to recover energy from fluid discharged from a boom actuator in a boom down operation and at the same time, improve the responsiveness of a jack-up motion.

BACKGROUND

Description of Related Art

A hydraulic machine is an apparatus configured to carry out work by supplying high pressure fluid to (an actuator of) a working device. To improve the fuel efficiency of the hydraulic machine, a technology of recovering energy contained in fluid discharged from an actuator of the working device has been proposed. Such a technology may reduce the consumption of fuel by recovering energy.

SUMMARY

Various aspects of the present disclosure provide a hybrid hydraulic machine to recover energy from fluid discharged from a boom actuator so as to reduce fuel consumption and at the same time, improve the responsiveness of a jack-up motion.

According to an aspect, a hydraulic machine may include: a boom actuator including a large chamber and a small chamber; a recovery unit configured to receive fluid discharged from the large chamber and then recover energy; a recovery line connecting the large chamber and the recovery unit; an accumulator connected to the recovery line; a jack-up assist line connecting the accumulator and the small chamber; a jack-up assist valve disposed on the jack-up assist line to block flow of fluid from the accumulator to the small chamber in a first position and allow the flow of fluid from the accumulator to the small chamber in a second position; and a controller configured to control movement of the jack-up assist valve.

In some embodiments, the controller may determine whether or not the hydraulic machine is in a jack-up condition, and when the hydraulic machine is determined to be in the jack-up condition, move the jack-up assist valve to the second position.

In some embodiments, the hydraulic machine may further include a first sensor configured to measure a pressure in the accumulator. The controller may control movement of the jack-up assist to the second position such that, the greater a value obtained by subtracting a pressure in the small chamber from the pressure in the accumulator measured by the first sensor is, the smaller the amount of the movement of the jack-up assist valve to the second position is.

In some embodiments, the hydraulic machine may further include a first operator input device by which an operator-desired operating speed of the boom actuator is input. The controller may control movement of the jack-up assist valve to the second position such that, the higher the operator-desired operating speed of the boom actuator, the greater the amount of the movement of the jack-up assist valve to the second position is.

In some embodiments, the controller may determine that the hydraulic machine is in the jack-up condition when a load pressure applied to the large chamber by a load is equal to or less than a threshold value.

In some embodiments, the threshold value may be in the range of 0 to 3 bars.

In some embodiments, the load pressure may be Pa−Pb/(Aa/Ab), where Pa is pressure in the large chamber measured by a second sensor, Pb is pressure in the small chamber measured by a third sensor, Aa is an area of the large chamber, and Ab is an area of the small chamber.

According to embodiments of the present disclosure, the hybrid hydraulic machine can recover energy from fluid discharged from a boom actuator so as to reduce fuel consumption and at the same time, improve the responsiveness of a jack-up motion.

The methods and apparatuses of the present disclosure have other features and advantages that will be apparent from or which are set forth in greater detail in the accompanying drawings, the disclosures of which are incorporated herein, and in the following Detailed Description, which together serve to explain certain principles of the present disclosure.

DETAILED DESCRIPTION

Hereinafter, embodiments of the present disclosure will be described in detail with reference to the accompanying drawings.

Figure 1:
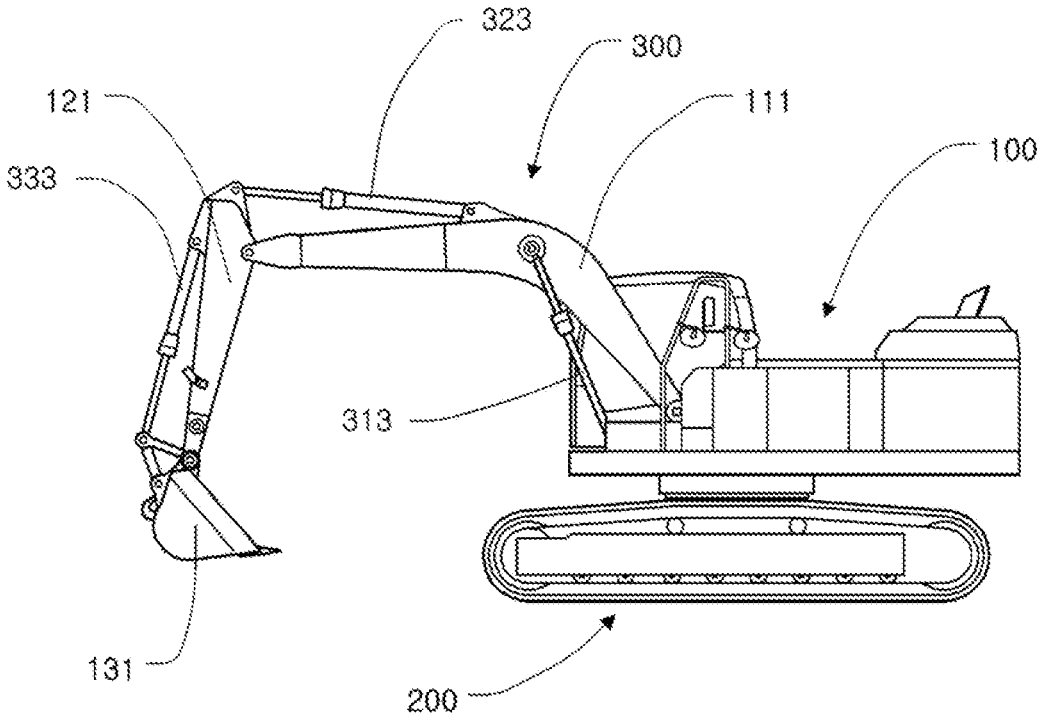
FIG. 1 is a schematic diagram illustrating an external appearance of a hydraulic machine according to some embodiments.

FIG. 1 is a schematic diagram illustrating an external appearance of a hydraulic machine according to some embodiments.

A hydraulic machine may carry out work by actuating a working device 300 using hydraulic pressure. In some embodiments, the hydraulic machine may be a construction machine.

In some embodiments, the hydraulic machine may be an excavator as illustrated in FIG. 1. The hydraulic machine may include an upper structure 100, an under structure 200, and the working device 300.

The under structure 200 includes a travel actuator allowing the hydraulic machine to travel. The travel actuator may be a hydraulic motor.

The upper structure 100 may include a working fluid tank, a pump, a power source, a control valve, and the like. In addition, the upper structure 100 may include a swing actuator allowing the upper structure 100 to rotate with respect to the under structure 200. The swing actuator may be a hydraulic motor.

The working device 300 allows the excavator to carry out work. The working device 300 may include a boom 111, an arm 121, and a bucket 131, as well as a boom actuator 313, an arm actuator 323, and a bucket actuator 333 actuating the boom 111, the arm 121, and the bucket 131, respectively. The boom actuator 313, the arm actuator 323, and the bucket actuator 333 may be hydraulic cylinders, respectively.

Figure 2:
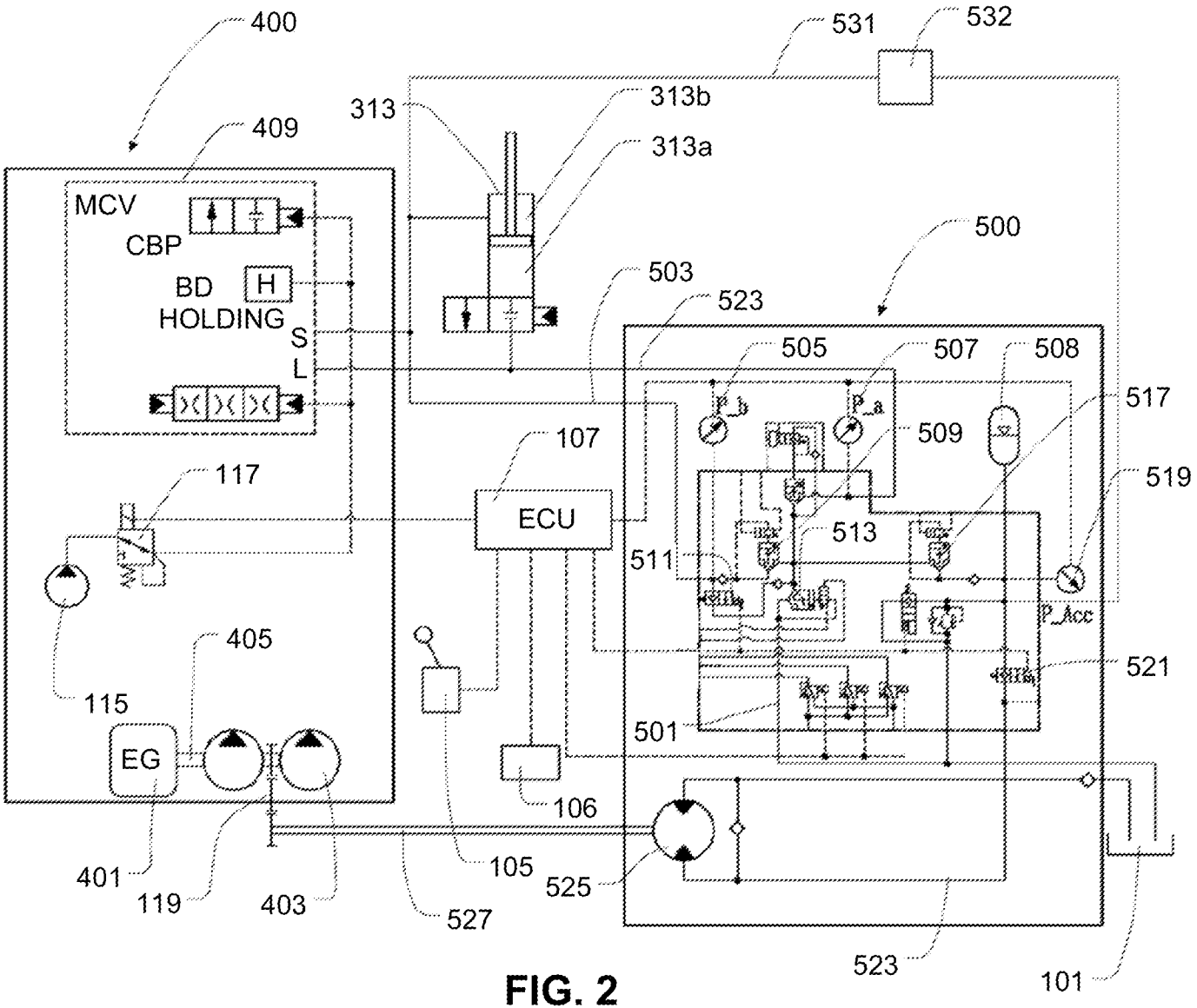
FIG. 2 schematically illustrates a hydraulic circuit of a hydraulic machine according to some embodiments.

FIG. 2 illustrates a hydraulic circuit of a hydraulic machine according to some embodiments.

In some embodiments, the hydraulic machine may include the boom actuator 313, an energy recovery circuit 500, a tank 101, and a controller 107. The energy recovery circuit 500 may be provided between the boom actuator 313 and the tank 101. The energy recovery circuit 500 may be connected to the boom actuator 313 to recover energy in fluid discharged from the boom actuator 313. In some embodiments, the energy recovery circuit 500 may include a return valve 513, a regeneration valve 509, a charging valve 517, and a recovery unit 525.

In some embodiments, the hydraulic machine may include an energy consumption circuit 400. The energy consumption circuit 400 may be provided between the tank 101 and the boom actuator 313. The energy consumption circuit 400 is a circuit connected to the boom actuator 313 to supply high pressure fluid to the boom actuator 313 or to return fluid discharged from the boom actuator 313 to the tank 101. In some embodiments, the energy consumption circuit 400 may include a power source 401, a main pump 403, and a control valve 409. The main pump 403 may direct pressurized fluid to the boom actuator 313. The power source 401 may drive the main pump 403. In some embodiments, the power source 401 may include an engine.

In some embodiments, the hydraulic machine may be configured to actuate the working device using the energy consumption circuit 400 at normal time and to recover energy using the energy recovery circuit 500 when a hybrid function is intended to be performed.

In some embodiments, the power source 401 may drive the main pump 403 by supplying power to the main pump 403 through a main shaft 405. The main pump 403 may pressurize fluid and direct the pressurized fluid to the boom actuator 313. The boom actuator 313 may receive the pressurized fluid from the main pump 403 and return fluid toward the tank 101. The boom actuator 313 may actuate the boom by providing the boom with the force by the pressurized fluid received from the main pump 403.

In some embodiments, the boom actuator 313 may be a hydraulic cylinder, and may include a large chamber 313*a* and a small chamber 313*b*. Since a piston rod connected to the boom extends through the small chamber 313*b*, an area Ab on which the fluid inside the small chamber 313*b* is in contact with the piston is smaller than an area Aa on which the fluid inside the large chamber 313*a* is in contact with the piston, due to the area occupied by the piston rod. Referring to FIG. 1, in a boom down operation in which the boom is lowered, the piston rod is also lowered. Consequently, fluid enters the small chamber 313*b*, while fluid is discharged from the large chamber 313*a*.

The control valve 409 may control the directions of flows of fluid between the main pump 403, the tank 101, and the boom actuator 313 by connecting the main pump 403, the tank 101, and the boom actuator 313. In some embodiments, the control valve 409 may be in a neutral position, a first non-neutral position, or a second non-neutral position. When the control valve 409 is in the neutral position, the control valve 409 may not be in fluid communication with the boom actuator 313 and return the fluid that has flowed from the main pump 403 to the tank 101 through a central bypass path. When the control valve 409 is in the first non-neutral position, the control valve 409 may prevent the fluid that has flowed from the main pump 403 from returning to the tank 101 through the central bypass path, direct the fluid that has flowed from the main pump 403 to the small chamber 313*b*, and direct the fluid that has flowed from the large chamber 313*a* to the tank 101, thereby allowing the boom to move down. When the control valve 409 is in the second non-neutral position, the control valve 409 may prevent the fluid that has flowed from the main pump 403 from returning to the tank 101 through the central bypass path, direct the fluid that has flowed from the main pump 403 to the large chamber 313*a*, and direct the fluid that has flowed from the small chamber 313*b* to the tank 101, thereby allowing the boom to move up.

In some embodiments, the hydraulic machine may include a first operator input device 105 to move the control valve 409. An operator may indicate his/her desire to raise or lower the boom by operating the first operator input device 105. In some embodiments, the first operator input device 105 may be a lever, but the present disclosure is not limited thereto.

In some embodiments, the first operator input device 105 may be an electrical input device, and may generate an electrical signal indicative of the operator's desire and transmit the electrical signal to the controller 107. In some embodiments, the hydraulic machine may include a pilot pump 115 and an electronic proportional pressure reducing valve 117. When an electrical signal is received from the first operator input device 105, the controller 107 may responsively operate the electronic proportional pressure reducing valve 117 by transmitting a control signal to the electronic proportional pressure reducing valve 117. When the electronic proportional pressure reducing valve 117 is in a first position, the electronic proportional pressure reducing valve 117 may allow the control valve 409 to move by directing pilot fluid that has flowed from the pilot pump 115 to the control valve 409. When the electronic proportional pressure reducing valve 117 is in a second position, the electronic proportional pressure reducing valve may block flow of the pilot fluid from the pilot pump 115 to the control valve 409 and allow the pilot fluid which has been provided to the control valve 409 to drain.

The return valve 513 may be provided between the large chamber 313*a* and the tank 101 to allow or block flow of fluid from the large chamber 313*a* to the tank 101. The regeneration valve 509 may connect the large chamber 313*a* and the small chamber 313*b* to allow or block flow of fluid from the large chamber 313*a* to the small chamber 313*b*. The charging valve 517 may be provided between the large chamber 313*a* and the recovery unit 525 to allow or block flow of fluid from the large chamber 313*a* to the recovery unit 525.

The recovery unit 525 is a power recovering component. In some embodiments, the recovery unit 525 may be a hydraulic motor (e.g., an assist motor). The assist motor may assist the power source 401 by providing the recovered power for the power source 401. In this regard, in some embodiments, the hydraulic machine may include a power transmission. The power transmission may be connected to the power source 401 and the assist motor to transmit power therebetween. In some embodiments, the power transmission may include the main shaft 405 connecting the power source 401 and the main pump 403, an assist shaft 527 connected to the assist motor, and a power transmission part 119. In some embodiments, the power transmission part 119 may include a gear train as illustrated in FIG. 2. However, the present disclosure is not limited thereto, and a variety of other embodiments are possible.

In some embodiments, the hydraulic machine may include a second operator input device 106 movable to indicate an operator's desire to select or deselect a hybrid mode. When the desire to select the hybrid mode is input to the second operator input device 106 and a desire for a boom down movement is input to the first operator input device 105, the controller 107 may control the electronic proportional pressure reducing valve 117 such that the pilot fluid is not suppliexl to the control valve 409, thereby moving the control valve 409 to the neutral position. In this manner, the controller 107 may block flow of fluid between the boom actuator 313 and the energy consumption circuit 400. Thus, in a situation in which the hybrid mode is activated, the boom down operation may only be induced by the weight thereof without the supply of the pressurized fluid by the main pump 403. When a desire to deselect the hybrid mode is input to the second operator input device 106 or no boom down desire is input to the first operator input device 105 even in the case that the desire to deselect the hybrid mode is input to the second operator input device 106, the controller 107 may move the return valve 513, the regeneration valve 509, and the charging valve 517 to block flow of fluid between the boom actuator 313 and the energy recovery circuit 500.

In some embodiments, in the boom down operation in which the boom is lowered, the return valve 513 may be moved to block flow of fluid from the large chamber 313*a* to the tank 101. In the boom down operation, the regeneration valve 509 may be moved to allow flow of fluid from the large chamber 313*a* to the small chamber 313*b*. In the boom down operation, the charging valve 517 may be moved to allow flow of fluid from the large chamber 313*a* to the recovery unit 525.

In some embodiments, the energy recovery circuit 500 may include a recovery line 523 connecting the large chamber 313*a* and the recovery unit 525. In some embodiments, the charging valve 517 may be provided on the recovery line 523. In some embodiments, the energy recovery circuit 500 may include a discharge valve 521 provided on the recovery line 523. In some embodiments, the energy recovery circuit 500 may include an accumulator 508 connected to the recovery line 523 between the charging valve 517 and the discharge valve 521. The charging valve 517 may allow or block flow of fluid from the large chamber 313*a* to the accumulator 508 through the recovery line 523. The discharge valve 521 may allow or block flow of fluid from the accumulator 508 to the recovery unit 525. In the boom down operation, the discharge valve 521 may be moved to allow flow of fluid to the recovery unit 525.

In some embodiments, in the boom down operation, the controller 107 may control the regeneration valve 509 and the charging valve 517 such that about half of a flow rate of high pressure fluid discharged from the large chamber 313*a* flows through the regeneration valve 509 to be regenerated and the remaining flow rate flows through the charging valve 517 to be stored in the accumulator 508. The stored flow rate is supplied to the recovery unit 525 through the discharge valve 521. Here, how much boom down energy is to be lost is determined depending on how much of areas of the regeneration valve 509, the charging valve 517, and the discharge valve 521 are controlled to be opened. In some embodiments, in the boom down operation (i.e., when receiving a boom down operation desire input by the operator using the first operator input device 105), the controller 107 may open the regeneration valve 509 and the charging valve 517 to the maximum extent and close the return valve 513 so as to minimize pressure loss.

In some embodiments, the hydraulic machine may include a first sensor 519 measuring pressure in the accumulator 508. In addition, the hydraulic machine may include a second sensor 507 measuring pressure in the large chamber 313*a* and a third sensor 505 measuring pressure in the small chamber 313*b*.

In some embodiments, the hydraulic machine may include a jack-up assist line 531 connecting the accumulator 508 and the small chamber 313*b* and a jack-up assist valve 532 disposed on the jack-up assist line 531. The jack-up assist valve 532 may block flow of fluid from the accumulator 508 to the small chamber 313*b* in a first position and allow flow of fluid from the accumulator 508 to the small chamber 313*b* in a second position. The controller 107 may control the jack-up assist valve 532 to move to the first position or the second position.

Figure 3:
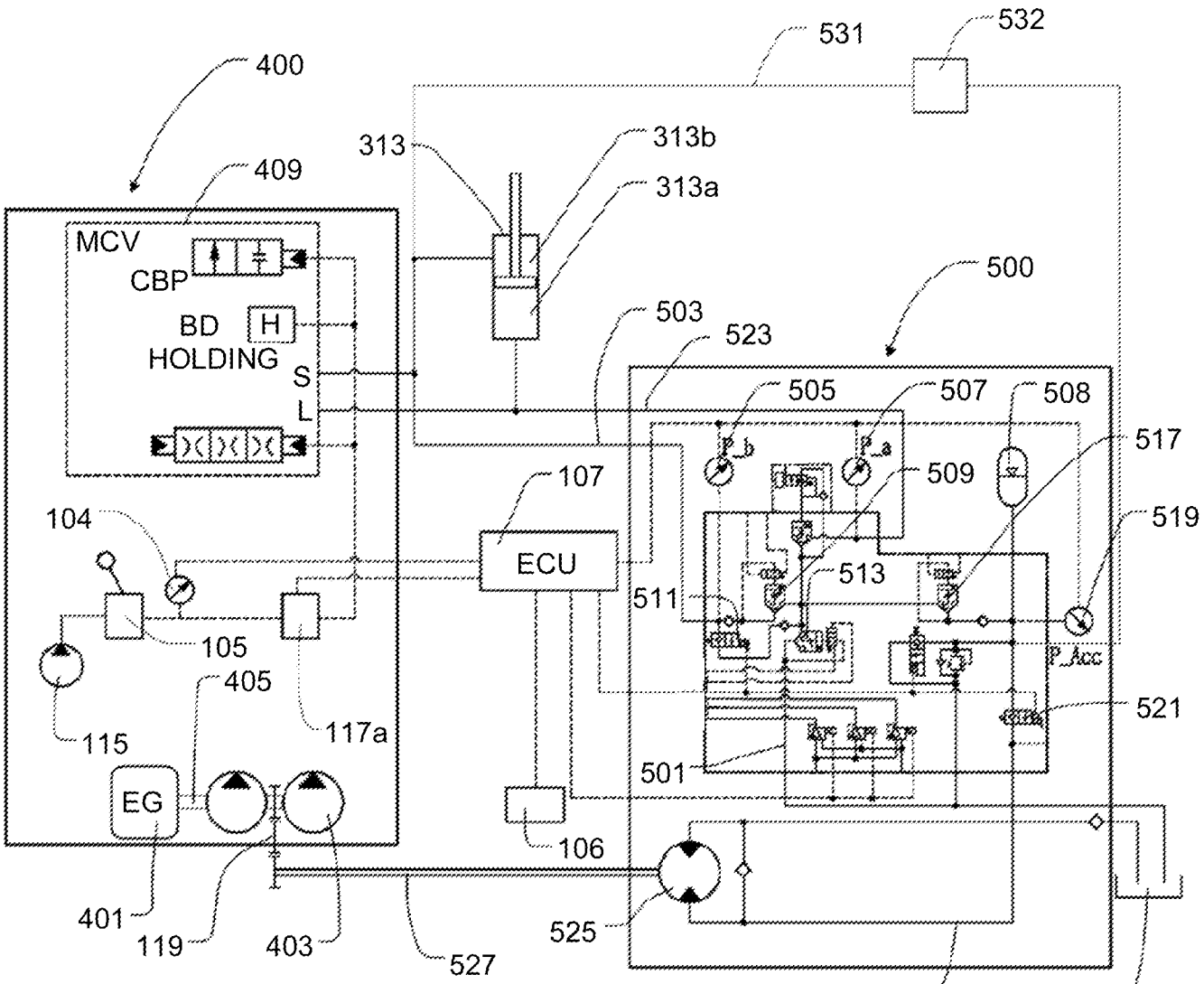
FIG. 3 schematically illustrates a hydraulic circuit of a hydraulic machine according to some embodiments.

FIG. 3 illustrates a hydraulic circuit of a hydraulic machine according to some embodiments.

In some alternative embodiments, the first operator input device 105 may be a hydraulic input device including a built-in pressure reducing valve (not shown), and the hydraulic machine may include an auxiliary valve 117*a*. In these embodiments, the pilot pump 115 may be connected to the pressure reducing valve of the first operator input device 105, and the pressure reducing valve may transmit a hydraulic signal indicative of an operator's desire input using the first operator input device 105, to the auxiliary valve 117*a*. In some embodiments, the hydraulic machine may include a sensor measuring the pressure of the hydraulic signal transmitted to the auxiliary valve 117*a* by the pressure reducing valve. The sensor may generate an electrical signal corresponding to the hydraulic signal and provide the electrical signal to the controller 107. Thus, although the controller 107 is not directly connected to the first operator input device 105, the controller 107 may determine what desire has been input by the operator, i.e., whether a boom down operation desire is input or a boom up operation desire is input. When a desire to deselect the hybrid mode is input through the second operator input device 106, a hydraulic signal generated by the first operator input device 105 may be transmitted to the control valve 409 through the auxiliary valve 117*a*. However, when a desire to select the hybrid mode is input to the second operator input device 106, even in the case that the boom down desire is input to the first operator input device 105, the controller 107 may control the auxiliary valve 117*a* such that the pilot fluid is not supplied to the control valve 409, thereby moving the control valve 409 to the neutral position. In this manner, the controller 107 may block flow of fluid between the boom actuator 313 and the energy consumption circuit 400.

Figure 4:
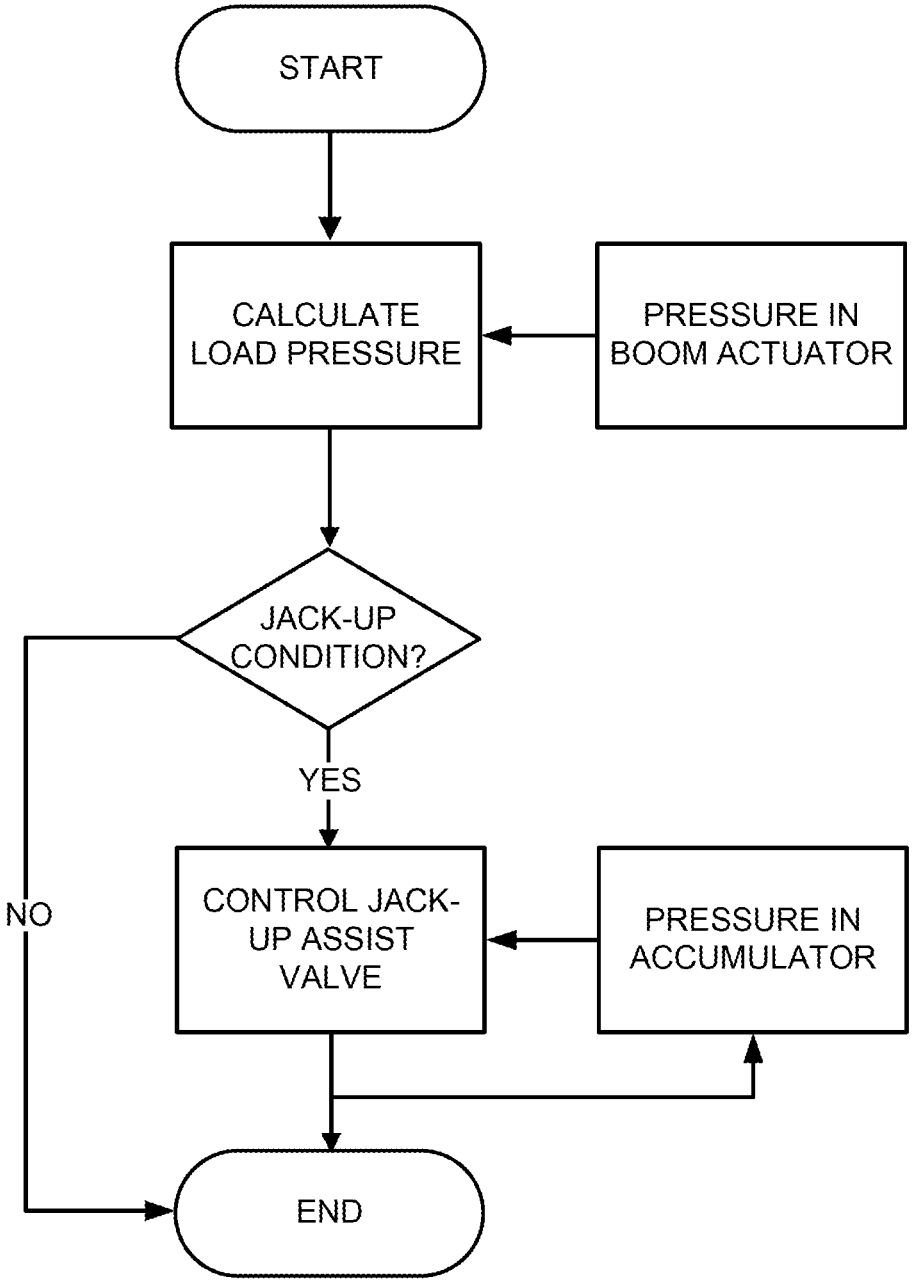
FIG. 4 is a flowchart schematically illustrating a jack-up assist method according to some embodiments.

FIG. 4 is a flowchart schematically illustrating a jack-up assist method according to some embodiments.

First, the controller 107 may calculate a load pressure applied to the large chamber 313*a* by a load. In some embodiments, the load pressure may be calculated as follows:

$$\text{Load pressure}=Pa-Pb/(Aa/Ab)$$

Here, Pa is a pressure in the large chamber 313*a* measured by the second sensor 507, Pb is a pressure in the small chamber 313*b* measured by the third sensor 505, Aa is an area of the large chamber 313*a*, and Ab is an area of the small chamber 313*b*.

Afterwards, the controller 107 may determine whether or not the hydraulic machine is in a jack-up condition. In some embodiments, the controller 107 may determine that the hydraulic machine is in the jack-up condition when the load pressure is equal to or less than a preset threshold value. In some embodiments, the threshold value may be in the range of 0 to 3 bars.

Subsequently, when the hydraulic machine is determined to be in the jack-up condition, the controller 107 may control the jack-up assist valve 532 to move according to a value obtained by subtracting the pressure in the small chamber 313*b* from the pressure in the accumulator 508 measured by the first sensor 519. The controller 107 may control the movement of the jack-up assist valve 532 so that, the greater the value obtained by subtracting the pressure in the small chamber 313*b* from the pressure in the accumulator 508 measured by the first sensor 519 is, the smaller the amount of the movement of the jack-up assist valve 532 to the second position (i.e., the opened area of the jack-up assist valve 532) is. (That is, the controller 107 may control the movement of the jack-up assist valve 532 so that, the smaller the value obtained by subtracting the pressure in the small chamber 313*b* from the pressure in the accumulator 508 measured by the first sensor 519 is, the greater the amount of the movement of the jack-up assist valve 532 to the second position (i.e., the opened area of the jack-up assist valve 532) is. Even in the case that the opened area of the jack-up assist valve 532 is the same, a higher flow rate of fluid is supplied to the small chamber 313*b* when the value obtained by subtracting the pressure in the small chamber 313*b* from the pressure in the accumulator 508 is greater. Thus, in order to supply an optimal flow rate of fluid to the small chamber 313*b* during the jack-up assist, the controller 107 may control the movement of the jack-up assist valve 532 so that, the greater the value obtained by subtracting the pressure in the small chamber 313*b* from the pressure in the accumulator 508, the smaller the opened area of the jack-up assist valve 532 is. When the hydraulic machine is determined to be in the jack-up condition, pressurized fluid stored in the accumulator 508 may be supplied to the small chamber 313*b* by moving the jack-up assist valve 532 to the second position, thereby improving the responsiveness of a jack-up motion.

In some embodiments, the controller 107 may control the movement of the jack-up assist valve 532 so that, the higher a desired movement speed of the boom actuator 313 input to the first operator input device 105, the greater the amount of the movement of the jack-up assist valve 532 to the second position is. (That is, the controller 107 may control the movement of the jack-up assist valve 532 so that, the lower the desired movement speed of the boom actuator 313 input to the first operator input device 105, the smaller the amount of the movement of the jack-up assist valve 532 to the second position is.) When the operator desires a high speed jack-up operation by increasing the amount of the movement of the first operator input device 105, a faster response characteristic may be obtained by responsively increasing a jack-up assist flow rate. In contrast, when the operator desires a quiet jack-up operation by reducing the amount of the movement of the first operator input device 105, rapid movement of the boom may be prevented by reducing the jack-up assist flow rate.

In some embodiments, the controller 107 may simultaneously perform the above-described control operations, i.e., the operation of controlling the amount of the movement of the jack-up assist valve 532 to the second position according to the value obtained by subtracting the pressure in the small chamber 313*b* from the pressure in the accumulator 508 and the operation of controlling the amount of the movement of the jack-up assist valve 532 to the second position according to the desired movement speed of the boom actuator 313 input to the first operator input device 105. That is, the controller 107 may control the amount of the movement of the jack-up assist valve 532 to the second position according to the value obtained by subtracting the pressure in the small chamber 313*b* from the pressure in the accumulator 508 and the desired movement speed of the boom actuator 313 input to the first operator input device 105.

The foregoing descriptions of specific exemplary embodiments of the present disclosure have been presented with respect to the drawings and are not intended to be exhaustive or to limit the present disclosure to the precise forms disclosed herein, and many modifications and variations would obviously be possible for a person having ordinary skill in the art in light of the above teachings.

It is intended, therefore, that the scope of the present disclosure not be limited to the foregoing embodiments, but be defined by the Claims appended hereto and their equivalents.

What is claimed is:

1. A hydraulic machine comprising:

a boom actuator comprising a large chamber and a small chamber;

a recovery unit configured to receive fluid discharged from the large chamber and then recover energy;

a recovery line connecting the large chamber and the recovery unit;

an accumulator connected to the recovery line;

a jack-up assist line connecting the accumulator and the small chamber;

a jack-up assist valve disposed on the jack-up assist line to block flow of fluid from the accumulator to the small chamber in a first position and allow the flow of fluid from the accumulator to the small chamber in a second position; and a controller configured to control movement of the jack-up assist valve, wherein the controller is configured to:

determine whether or not the hydraulic machine is in a jack-up condition; and when the hydraulic machine is determined to be in the jack-up condition, move the jack-up assist valve to the second position.

2. The hydraulic machine of claim 1, further comprising a first sensor configured to measure a pressure in the accumulator, wherein the controller controls movement of the jack-up assist to the second position such that the greater a value obtained by subtracting a pressure in the small chamber from the pressure in the accumulator measured by the first sensor is, the smaller the amount of the movement of the jack-up assist valve to the second position is.

3. The hydraulic machine of claim 1, further comprising a first operator input device by which an operator-desired operating speed of the boom actuator is input, wherein the controller controls movement of the jack-up assist valve to the second position such that the higher the operator-desired operating speed of the boom actuator, the greater the amount of the movement of the jack-up assist valve to the second position is.

4. The hydraulic machine of claim 1, wherein the controller determines that the hydraulic machine is in the jack-up condition when a load pressure applied to the large chamber by a load is equal to or less than a threshold value.

5. The hydraulic machine of claim 4, wherein the threshold value is in a range of 0 to 3 bars.

6. The hydraulic machine of claim 4, wherein the load pressure is Pa−Pb/(Aa/Ab), where Pa is pressure in the large chamber measured by a second sensor, Pb is pressure in the small chamber measured by a third sensor, Aa is an area of the large chamber, and Ab is an area of the small chamber.

* * * * *